US005971788A

United States Patent [19]

Niitsu et al.

[11] Patent Number: 5,971,788

[45] Date of Patent: Oct. 26, 1999

[54] ELECTRICAL CONNECTOR WITH REINFORCED ENGAGEMENT MEANS

[75] Inventors: Toshihiro Niitsu; Minoru Fukushima, both of Yokohama, Japan

[73] Assignee: Molex Incorporated, Lisle, Ill.

[21] Appl. No.: 08/786,075

[22] Filed: Feb. 28, 1997

[30] Foreign Application Priority Data

Feb. 22, 1996 [JP] Japan ..... 8-060162

[51] Int. Cl.[6] ..... H01R 13/627

[52] U.S. Cl. ..... 439/350; 439/353

[58] Field of Search ..... 439/350–358, 439/79, 570

[56] References Cited

U.S. PATENT DOCUMENTS

| | | | |
|---|---|---|---|
| 3,711,816 | 1/1973 | Schumacher | 439/352 |
| 4,708,662 | 11/1987 | Klein | 439/353 |
| 4,923,409 | 5/1990 | Ishii | 439/358 |
| 5,011,424 | 4/1991 | Simmons | 439/352 |
| 5,037,316 | 8/1991 | Fukushima et al. | 439/79 |
| 5,127,848 | 7/1992 | Taguchi | 439/489 |
| 5,157,473 | 10/1992 | Takahashi et al. | 439/353 |
| 5,222,904 | 6/1993 | Ishizuka et al. | 439/352 |
| 5,297,966 | 3/1994 | Brennian, Jr. et al. | 439/570 |
| 5,338,211 | 8/1994 | Kodama et al. | 439/135 |
| 5,362,248 | 11/1994 | Hashiguchi et al. | 439/350 |
| 5,378,168 | 1/1995 | Sumida | 439/358 |
| 5,486,117 | 1/1996 | Chang | 439/357 |

FOREIGN PATENT DOCUMENTS

| | | | |
|---|---|---|---|
| 0415489 A1 | 8/1990 | European Pat. Off. | H01R 23/10 |
| 6-79081 | 11/1994 | Japan | H01R 13/639 |

*Primary Examiner*—Hien Vu
*Attorney, Agent, or Firm*—Charles S. Cohen

[57] ABSTRACT

An electrical connector has improved locking characteristics for mating with an opposing complementary connector component. The connector has an insulative housing with a series of walls defining a mating space which receives the complementary connector component. Terminals are arranged in the mating space to interconnect with the complementary connector component. Sidewalls have two distinct inner and outer sections wherein the inner sidewall section are flexible and include an engagement surface for engagement with the complementary connector component.

12 Claims, 4 Drawing Sheets

ELECTRICAL CONNECTOR WITH REINFORCED ENGAGEMENT MEANS

BACKGROUND OF THE INVENTION

The present invention relates to electrical connectors and more particularly to an electrical connector component having a reliable latching member formed in its housing for engaging a complementary mating connector component.

Electrical connectors are used for many applications and such connectors are commonly used to connect two printed circuit boards together. One such connector is known which has a connector housing with a mating cavity disposed between opposing sidewalls of the housing that are of uniform thickness. A plurality of electrically conductive terminals are arranged along the mating cavity with their contact sections positioned therein. Such connectors may have some type of latch means formed in the sidewalls for fastening a mating connector component thereto. The latch means may take the form of an opening or step-like indentation which catches a resilient tongue formed in the mating connector-component.

These type of locking connectors are designed for use on printed circuit boards and accordingly, it is desirable to have the size of the connector reduced as much as possible. In order to meet this reduced size requirement, it would be desirable to reduce the thickness of the sidewalls of the connector housing. However, this reduction may result in a detrimental loss of mechanical strength when such thin walls are provided with the latch openings or indentations.

The present invention is therefore directed to a connector structure which has a reliable engagement feature that overcomes the aforementioned disadvantage and does not result in a detrimental decrease in the mechanical strength of the connector.

SUMMARY OF THE INVENTION

Accordingly, an object of the present invention is to provide a locking-type electrical connector structure which permits a maximum reduction in the size of the connector, while still ensuring that its sidewalls retain sufficient mechanical strength for reliable engagement with a complementary-shaped mating connector component.

To attain this object, the present invention provides an electric connector comprising a housing having a plurality of sidewalls which define a mating cavity and a plurality of terminals fixed to the housing with their contact sections positioned in the mating cavity. Two of the sidewalls which serve to define the mating cavity of the connector housing have inner and outer wall sections, the inner wall section being resilient and having a locking means formed therein which engages the mating connector component when mated together and, the outer wall section providing mechanical strength.

The terminals of the connector may have solder tails lying generally flush with the bottom surface of the housing to permit the soldering of the soldering tails to the surface of a printed circuit board.

The mating cavity is defined by two opposite sidewalls of the connector component, a ceiling or top wall of the connector housing, and a floor or bottom wall. The inner and outer wall sections cooperate to form a double-walled sidewall structure and, in accordance with the principles of the present invention, this double wall characteristic permits the outer wall to retain a good and sufficient mechanical strength to the structure, while letting the inner wall function independently as a resilient fastening structure of the mating cavity.

These and other objects, features and advantages of the present invention will be clearly understood through a consideration of the following detailed description.

BRIEF DESCRIPTION OF THE DRAWINGS

In the course of the following description of the detailed description, reference will be made to the attached drawings wherein like reference numerals identify like parts and wherein.

DESCRIPTION OF THE PREFERRED EMBODIMENT

Figure 1:
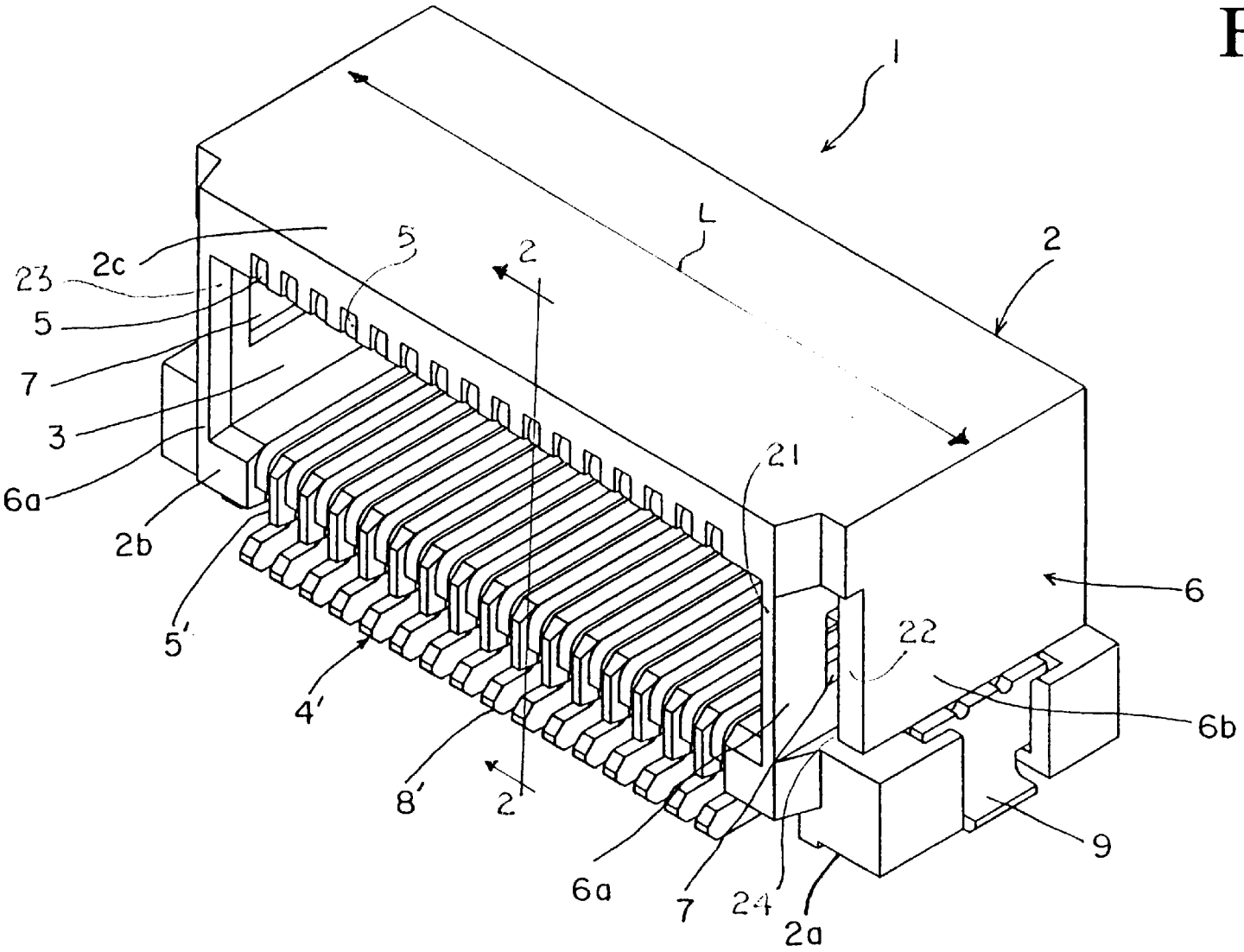
FIG. 1 is a perspective view of an electrical connector component constructed in accordance with the principles of the present invention.

Turning first to FIG. 1, an electric connector component constructed in accordance with the principles of the present invention is illustrated generally at 1. This connector 1 is shown in the drawings as being of a "right-angle" type, but it will be understood that this specific configuration is intended only for exemplary purposes and the principles of the present invention may be used with other connector component configurations.

The connector component 1 includes an elongated, insulative housing 2 having a mating cavity or receptacle 3 formed therein and oriented generally at a right angle to the plane of the printed circuit board surface (not shown) upon which the connector is mounted. The mating cavity 3 opens at the front 2*b* of the connector component in order to accommodate a mating connector component (not shown). A plurality of terminals 4, 4' are fixed to the housing 2 with their contact sections 5, 5' arranged in parallel fashion within and along opposite sides of the mating cavity 3. The opposite sidewalls 6 of the housing 2 cooperate with the ceiling plate, or top wall 2*c*, of the connector housing 2 and the floor, or bottom wall 2*d*, of the connector housing 2 to partly define the mating space 3.

As best seen in the cross-sectional view of FIG. 2, the upper set of terminals 4 at the top of the connector component has solder tails 8 lying at or just below the bottom surface 2*a* of the housing 2, so that the connector 1 may be fixed to a printed circuit board by surface mount soldering the solder tails 8 of the terminals to selected conductive pads of the printed circuit board. The lower set of terminals 4' of the connector 1, which are spaced apart from the upper set 4, are disposed along the bottom of the mating cavity 3 of the connector component 1. The solder tails 8' of these second terminals 4' also lie at or just below the bottom surface 2*a* of the connector component and preferably lie in a common plane with the solder tails of the upper set of terminals 4.

Figure 2:
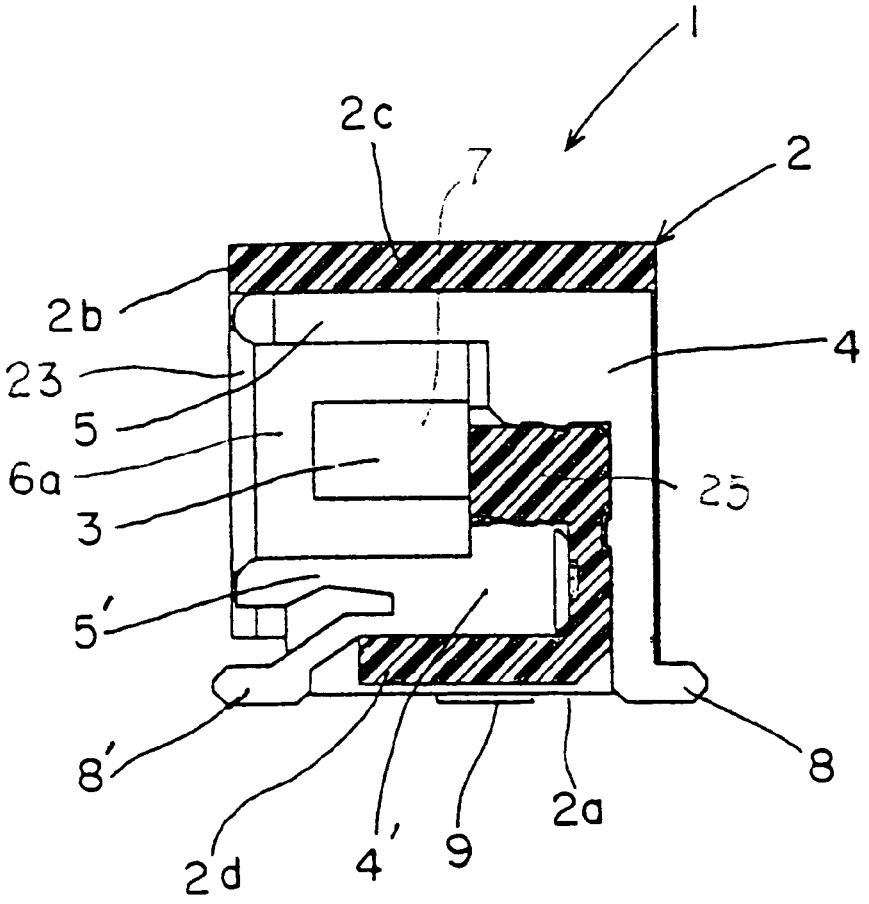
FIG. 2 is a cross sectional view of the connector component of FIG. 1 taken along lines 2—2 thereof.
Figure 3:
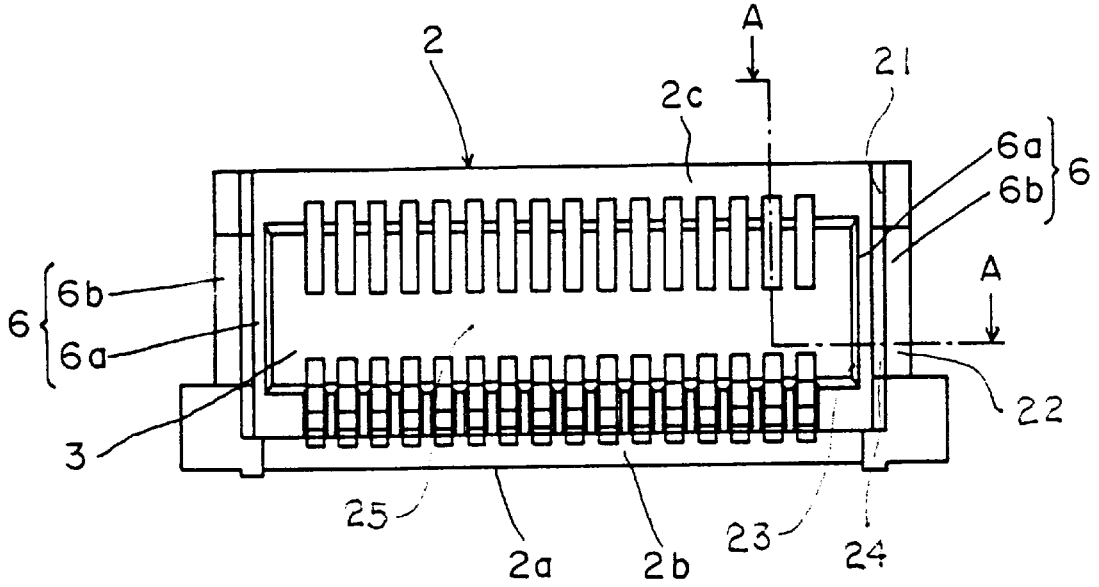
FIG. 3 is a front elevational view of the connector component of FIG. 1.
Figure 4:
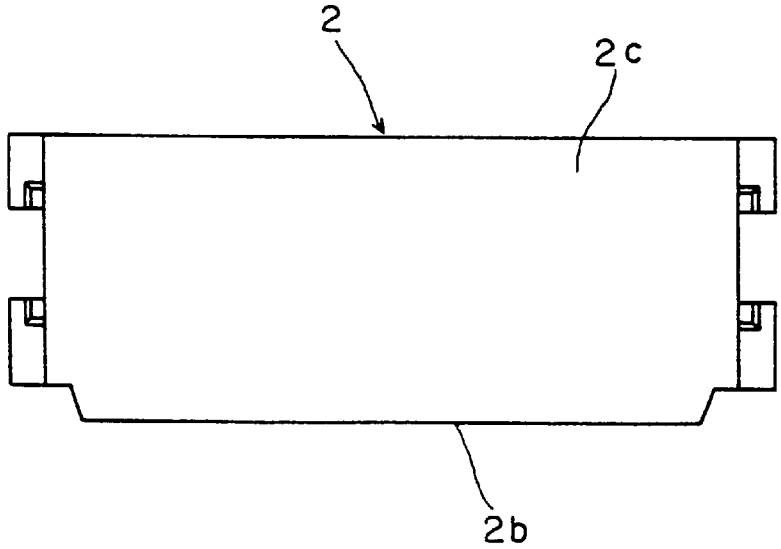
FIG. 4 is a plan view of the connector component of FIG. 1.
Figure 5:
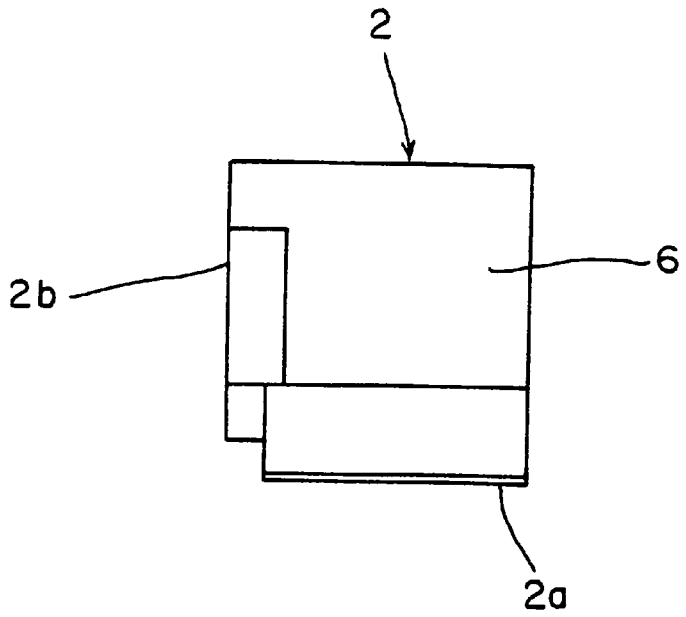
FIG. 5 is a plan view of the connector component of FIG. 1.

As best seen in FIGS. 1 & 2, each sidewall 6 of a housing 2 has a generally right angled metal fastener 9 fixed to its lower part. The fastener 9 of each sidewall 6 is configured to permit the housing 2 to be soldered to a selected area of a printed circuit board when the terminals 4, 4' are soldered to selected conductive pads of the printed circuit board (not shown).

These sidewalls 6 include distinct inner and outer wall sections 6*a* and 6*b*. As seen from FIGS. 1 & 6, the inner wall section 6*a* extends forwardly of its associated outer wall section 6*b* and has an engagement slot, or opening 7, illustrated as a rectangular recess, defined therein in order to catch and fasten the mating connector component by permitting a latching piece of the mating connector component or locking projection, to fall within and engage the engagement opening 7 when the two components are mated together. As such, the inner wall is relatively thin so as to be flexible. The outer wall section 6*b* is flat in nature, and is thick enough to provide good mechanical strength to the sidewall. The inner and outer wall sections 6*a*, 6*b* are separated in the embodiment illustrated by an intervening space 24 so that the inner wall section 6*a* has sufficient room or space from the outer wall section 6*b* to permit the inner wall section to flex in the longitudinal direction "L" (FIG. 1) during mating with the opposing mating connector while the outer wall section 6*b* primarily provides structural support to the connector housing by interconnecting the top wall 2*c* and the bottom wall 2*d* together.

Figure 6:
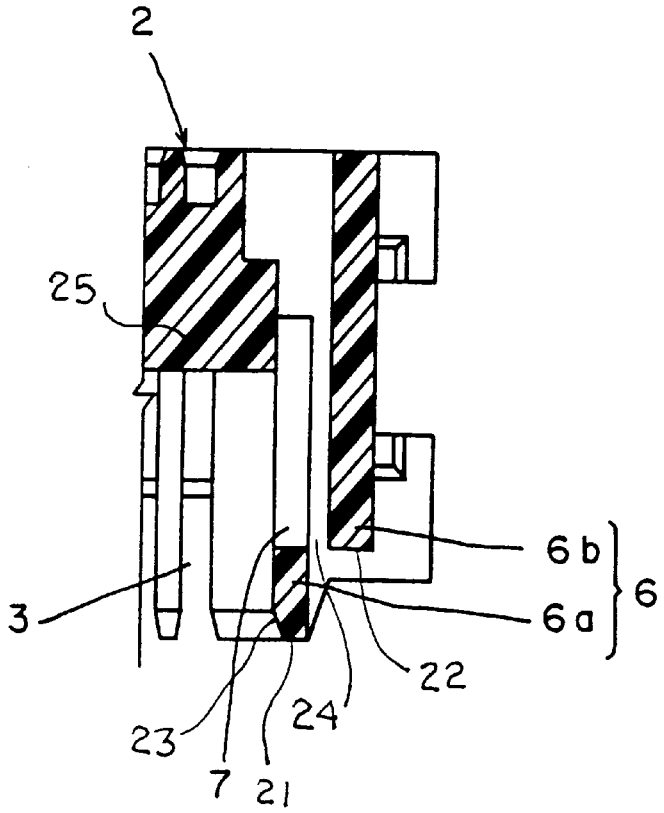
FIG. 6 is an enlarged cross section of the electric connector taken along the lines 6 in FIG. 3.

As seen in FIGS. 1 & 6, the inner wall portion 6*a* lies interior of the outer wall portion 6*b* of the sidewalls 6 of the connector housing 2. The inner wall portion 6*a* is slightly spaced apart from the outer wall portion 6*b* as illustrated in FIG. 6. The front, or leading edge 21, of the inner wall portion 6*a* may also extend forwardly past the front, or leading edge 22, of the outer wall portion 6*b* and give the sidewalls 6 a stepped configuration when viewed from either of the top or bottom walls 2*c*, 2*d* of the connector housing 2.

The leading edge 21 of the inner wall section 6*a* may have an inclined or ramped inner edge 23 which extends away from the outer wall sections 6*b* toward the mating space 3 to act as lead-in to facilitate insertion of the mating connector component.

The top and bottom walls 2*c*, 2*d* floor of the housing 2, which, along with the opposite sidewalls 6, define the mating cavity 3, are thick enough to ensure a required mechanical strength. Thus, the connector component 1 may be advantageously reduced in size without causing any problems which result in the deterioration of the connector components overall mechanical strength. In addition, the connector housing 2 includes a rear wall 25 which serves as a base of the mating cavity 3 and into which retention sections of terminals 4, 4' are secured. The mating connector component may be inserted into the mating cavity 3 of the connector component 1 without substantial concern of degradation of the connector housing due to loss in strength or deformation of the sidewalls 6 due to the sufficient mechanical strength provided by the double wall structure of the sidewalls 6. The mating connector component may then be fastened to the connector component 1 by permitting the latch pieces (which will typically take the form of projecting lugs or the like) of the mating connector component to fall into and engage the openings 7 of the inner wall sections 6*a* of the opposite sidewalls 6 of the connector component 1. In the alternative, the projecting lugs of the latch structure could be located on inner wall portion 6*a* rather than on the mating connector component. In such instance, the mating connector component would include an opening or recess into which each lugs would fit during mating.

The present invention is described as being applied to a "right-angle type" electric connector using terminals whose solder tails can be soldered to contact pads on the surface of a substrate, but the present invention can be equally applied to a "through hole" electric connector using terminals whose solder tails extend through holes in the printed circuit board so that they may be wave soldered. Also, the inner wall section 6*a* of the double-walled structure 6 may have a step-like indentation as a locking means in place of the opening 7.

As may be understood from the above, due to the double-walled structure on each side of the housing, a required mechanical strength can be obtained in the electric connector structure even though its size has been substantially reduced. The outer wall section of substantial thickness provides a required mechanical strength to the housing around the engagement area designated by the engagement opening 7, thereby permitting the apertured or step-like indented inner wall section to function as a resilient latch.

It will also be understood that the embodiments of the present invention which have been described are illustrative of some of the applications of the principles of the present invention. Various modifications may be made by those skilled in the art without departing from the true spirit and scope of the invention.

We claim:

1. An electrical connector comprising: a one piece insulative housing, the connector housing including spaced apart generally parallel top and bottom walls and two spaced apart sidewalls generally perpendicular to said top and bottom walls to partially define a mating component-receiving cavity within the housing and a plurality of electrically conductive terminals with a portion of each said terminal disposed within a respective one of the component-receiving cavities and a contact tail of each said terminal extending outwardly from its respective cavity;

each of said sidewalls having distinct, spaced apart inner and outer sidewall portions, the inner sidewall portion being flexible and including an engagement slot for engaging and latching a complementary mating component and the outer sidewall portions extending between said top and bottom walls and providing structural support for said connector housing, said top and bottom walls and said inner sidewall portions of each of said sidewalls including a leading edge defining a generally rectangular mating face, each said inner sidewall portion extending along said leading edge and interconnecting said top and bottom walls, and each said inner sidewall including an opening therein and said engagement slot is part of said opening.

2. The connector as defined in claim 1, wherein said inner and outer sidewall portions have distinct respective leading edges, the leading edges of said inner sidewall portions extending past said outer sidewall portion leading edges.

3. The connector as defined in claim 1, wherein said connector housing includes a rear wall defining a base of said component-receiving cavity, the rear wall interconnecting said outer sidewall portions together and said engagement slots extending between said sidewall inner wall portions and said rear wall.

4. The connector as defined in claim 3, wherein said terminals include mounting portions and said mounting portions are secured within said rear wall.

5. The connector as defined in claim 4, wherein said terminal solder tail and contact portions extend generally parallel to each other.

6. The connector as defined in claim 1, wherein said connector housing includes opposing, spaced-apart walls which interconnect said sidewalls together at said outer sidewall portions thereof.

7. The connector as defined in claim 1, wherein each of said pair of said inner wall portion and said outer wall portion are spaced apart along a longitudinal axis of said housing.

8. An electrical connector comprising:

a one-piece, elongated insulative housing including first and second pairs of opposing spaced-apart housing walls, said first pair of said housing walls extending generally parallel to a longitudinal axis (L) of said connector housing and defining top and bottom longitudinal walls of said housing, said second pair of housing walls extending generally transversely to the longitudinal axis (L) and defining a pair of transverse sidewalls of said connector housing, the transverse sidewalls and longitudinal walls defining a component receiving cavity for receiving a complementary mating connector component therein and including a leading edge defining a generally rectangular mating face;

a plurality of electrically conductive terminals mounted in the housing, a contact portion of each terminal being disposed within the cavity generally along one of said top and bottom longitudinal walls, and each said terminal including a solder tail portion which lies adjacent one of said top and bottom longitudinal walls;

each said transverse sidewall having inner and outer portions, the inner and outer portions being spaced apart along the longitudinal axis, the trasverse sidewall outer portions interconnecting said top and bottom longitudinal walls together in order to provide structural support to said transverse sidewalls, each inner portion extending along said mating face between said top and bottom longitudinal walls providing a distinct, flexible engagement member to said transverse sidewalls adjacent said component receiving cavity, said engagement member being configured for engagement with a latching portion of said complementary mating connector component.

9. The connector as defined in claim 8, wherein said inner and outer portions have respective leading edges, the inner portion leading edges extending past said outer portion leading edges such that said transverse walls have a stepped configuration when viewed from said longitudinal walls.

10. The connector as defined in claim 8, wherein said inner portions have engagement slots disposed therein.

11. The connector as defined in claim 10, wherein said connector housing includes a base wall defining a rear of said cavity, the rear wall interconnecting said walls together and said engagement slots extending in said inner portions past said rear wall.

12. The connector as defined in claim 8, wherein said space between said inner and outer portions extends through said connector housing to isolate said transverse inner and outer portions from each other.

* * * * *